US005697246A

United States Patent [19]

Kuroda et al.

[11] Patent Number: 5,697,246

[45] Date of Patent: Dec. 16, 1997

[54] PRESSING METHOD AND PRESSING APPARATUS FOR THE SAME

[75] Inventors: Yoshitaka Kuroda, Anjo; Keiji Sasaki, Toyota, both of Japan

[73] Assignee: Nippondenso Co., Ltd., Kariya, Japan

[21] Appl. No.: 599,269

[22] Filed: Feb. 9, 1996

[30] Foreign Application Priority Data

Feb. 10, 1995 [JP] Japan ..... 7-022887

[51] Int. Cl.[6] ..... B21D 22/00

[52] U.S. Cl. ..... 72/356; 72/379.2; 72/403

[58] Field of Search ..... 72/348, 356, 379.2, 72/403, 404, 414, 421, 386

[56] References Cited

U.S. PATENT DOCUMENTS

| | | | |
|---|---|---|---|
| 2,213,648 | 9/1940 | Fraser | 72/386 |
| 3,425,260 | 2/1969 | Anderson et al. | 72/403 |
| 4,543,811 | 10/1985 | Aoyama | 72/379.2 |
| 5,361,619 | 11/1994 | Kojima et al. . | |
| 5,417,097 | 5/1995 | Kojima et al. . | |

FOREIGN PATENT DOCUMENTS

| | | | |
|---|---|---|---|
| 2039900 | 3/1971 | Germany . | |
| 0233020 | 9/1989 | Japan | 72/379.2 |
| 0289531 | 11/1989 | Japan | 72/353.2 |
| 6-99230 | 4/1994 | Japan . | |
| 6154895 | 6/1994 | Japan | 72/379.2 |

*Primary Examiner*—Lowell A. Larson
*Assistant Examiner*—Ed Tolan
*Attorney, Agent, or Firm*—Cushman, Darby & Cushman IP Group of Pillsbury Madison & Sutro LLP

[57] ABSTRACT

To provide a pressing method for forming dual drawn products having various product lengths, such as radiator core plate, with one type of a die unit and for preventing significant damages, which may be caused to the packing seal surface. The pressing method according to the present invention, which uses a punch and a die divided into a first die part and a second die part, sequentially includes a first drawing step for drawing the material with the punch and the first die part of a die to form a first end portion of the product; and a second drawing step for drawing the material with the punch and the second die part of the die to form a second end portion of the product.

9 Claims, 8 Drawing Sheets

120
120B
120A
X
Y
R2
R1
P
20
22
22F
22W
110B
110
110A
120S
121E
121
122
123
124A
124B
125

PRESSING METHOD AND PRESSING APPARATUS FOR THE SAME

CROSS REFERENCE TO RELATED APPLICATION

This application is based on and claims priority of Japanese Patent Application No. 7-22887 filed on Feb. 10, 1995, the content of which is incorporated herein by reference.

BACKGROUND OF THE INVENTION

1. Field of the Invention

The present invention generally relates to a pressing method and a pressing apparatus for implementing the pressing method. More particularly, the present invention relates a pressing method for pressing a dual-drawn and long product having an elevated inside and outer circumferential portions bent to upwardly to form a groove for receiving a packing by drawing from a band-like plate material and a pressing apparatus implementing such pressing method. The present invention is particularly advantageous when used for pressing a dual-drawn and long product, such as automotive radiator core plate.

2. Description of Related Art

An automotive radiator basically includes a core for cooling engine cooling water by air and tanks mounted on each side of the core as cooling water inflow and outflow buffers.

As one of the conventional radiators commonly used as such automotive radiators, a tube type radiator has been known. In this tube type radiator, a core includes a plurality of tubes as cooling water passages arranged in parallel with each other so as to form a clearance therebetween, each end of the tubes is inserted into hole in a core plate and fixed to the core plate, and radiating fins are inserted in the clearances between the tubes and bonded to the outer surfaces of the tubes. A tank is manufactured separately from the core and shaped like a container. An opening brim portion of the tank is inserted into a groove located along the outer circumference of the core plate and bonded thereto, an integrated radiator being thereby assembled.

The core (including the core plate) is made of a metal, such as aluminum, to obtain cooling effect. The tank is selectively made of the same type aluminum as the core or resin depending on the use. When the tank is made of aluminum, the core plate and the tank are bonded together by brazing. On the other hand, when the tank is made of a resin, the core plate and the tank are bonded together by crimping with a packing made of rubber or the like therebetween, because the brazing process can not be used.

FIG. 6 illustrates an automotive radiator plate which is bonded to the tank by crimping. A core plate 10 is a dual-drawn product having a protuberance inside 10A formed by drawing and outer circumferential portions 10B bent upwardly by drawing from a band-like plate material to form a groove for receiving a packing. The protuberance inside 10A includes burring holes 11 for receiving the tubes.

Conventionally, the core plate 10 has been pressed by an expensive transfer pressing apparatus to prevent damages which may be caused to a bottom surface defining the groove for receiving a packing (a seal surface with which the packing contacts) 10C and the resulting leakage of cooling water during the operation of the radiator. As illustrated in FIG. 6, there are typically wrinkly damages (shock marks) 60A caused to corners of the base portion of the outer circumferential edge 10B bent upwardly. In FIG. 6, another wrinkly damage 60B may be caused when the corner is drawn. Further, as illustrated in FIG. 7, damages (shock marks) 22D may be caused to corner portions and flange surfaces when the protuberance inside is drawn.

Moreover, as the length of the core plate varies according to the size of the radiator, a variety of dies are necessary according to the length of the core plate. As a result, there have been problems that the die change takes time, the rate of operation falls, and the cost for the dies increases greatly.

A pressing method capable of changing the pressing length properly according to a variety of product lengths has been disclosed in the Japanese Unexamined Patent Publication Nos. Hei. 6-99230 and Hei. 6-79360.

According to the pressing method disclosed in the Japanese Unexamined Patent Publication No. Hei. 6-99230, a sequential pressing apparatus includes means for intermitting a pressing operation of the die, and such means for intermitting the pressing operation is disposed within the die. Thereby, the necessary pressing spots or the necessary number of times of the pressing can properly be changed according to the product length. However, this sequential pressing method can not prevent damages to the packing seal surface of the dual drawn products, such as a radiator core plate, as described above.

On the other hand, a pressing method disclosed in the Japanese Unexamined Patent Publication No. Hei. 6-79360 is a dual-step pressing method, in which when a container-shaped and drawn product is pressed from a plate material, both end portions and central portion of the plate material are sequentially deeply-drawn with respective dies. When the central portion is pressed after both end portions are pressed, the pressing area may be overlapped unless each pressed shape of both end parts is deformed. Therefore, products in a considerable variation-range of the product length may be pressed with the same die, and a variety of products having different lengths can be pressed with a few different types of dies. In the dual-step pressing method, the container-type products can be pressed. However, there is a problem that punching holes for receiving the tube cannot be formed by the dual-step pressing method, which is necessary for radiator core plates.

SUMMARY OF THE INVENTION

A primary object of the present invention is to provide a pressing method capable of pressing products having a variety of product lengths with one type die and preventing significant damages to a packing seal surface and also to provide a pressing apparatus to implement such pressing method.

The inventors of the present invention assumed that the damages on the bottom surface for forming an inner groove for receiving the packing are caused by the sequential pressing method due to the inward pulling of the material while the inside protuberance is being formed and the concurrent outward pulling of the material while the inner groove by the outer circumference edge portions is being formed.

Assuming as described above, according to the present invention, the pressing method includes a first drawing step for protruded inside, and a second drawing step for sequential drawing outer circumference edge portions bent upwardly to form an inner groove therearound. In this way, by differentiating the time of the first drawing step in which the material is pulled inward from the second drawing step in which the material is pulled outward, damages to the seal surface can be prevented.

In the first drawing step, the conventional sequential pressing method is applicable, as disclosed in the Japanese Unexamined Patent Publication No. 6-99230, where a punch which can draw both end parts with respect to the material feed direction is used as a punch for drawing to protrude the inside, and a die which is divided into the first half die part and the second half die part with respect to the material feed direction is used as a die to correspond to the punch. However, according to the present invention, to prevent damages which may be caused if the prior art is used as it is, the following two improvements are further employed. The first improvement is that the damages (particularly damages to the packing seal surface) due to the inflow of the material to be drawn at the separate portion are prevented by providing taper to the above separate end portions of the flange holding surface of the first half die part and second half die part toward the separate surface. The second improvement is that seal mark damages to the corner portions of the protuberance portion and flange portion is prevented by making the roundness of the corner portion between front end surface of the first half die part and the flange holding surface and the roundness of the rear end surface of the second half die part and the flange holding surface being more gentle than the roundness of the corner portions between both side surfaces and the flange holding surface in the die cavity.

In the second drawing step, the conventional dual drawing method is applicable, as disclosed in the Japanese Unexamined Patent Publication No. 6-79360, where both end portions and central portion of the primary pressed product are edge raised by the sequential drawing with the respective separate molds to form the inner groove by the outer circumference edge portions.

However, according to the present invention, to prevent damages which may be caused if the prior art is used as it is, the following improvement is further employed. That is, the damages due to the inflow of the material to be drawn at the separate surface are prevented in the same way as described as to the separate die in the above first drawing step by providing taper to at least either of the front end portion of the punch or the bottom surface of the die at the separate end portion of each punch and die toward the separate surface.

BRIEF DESCRIPTION OF DRAWINGS

Additional objects and advantages of the present invention will be more readily apparent from the following detailed description of preferred embodiments thereof when taken together with the accompanying drawings in which:

FIG. 4A is a perspective view illustrating the inside protuberance with a punch and a die, FIG. 4B is a perspective view illustrating the material where the inside protuberance is formed, FIG. 4C is a perspective view illustrating the punch, FIG. 4D is a cross-sectional view taken along the line X—X, and FIG. 4E is a cross-sectional-view taken along the line Y—Y;

DETAILED DESCRIPTION OF THE PRESENTLY PREFERRED EMBODIMENTS

Referring to FIGS. 1 through 9, an embodiment of pressing method for an automotive radiator core plate according to the present invention will now be described.

Figure 1:
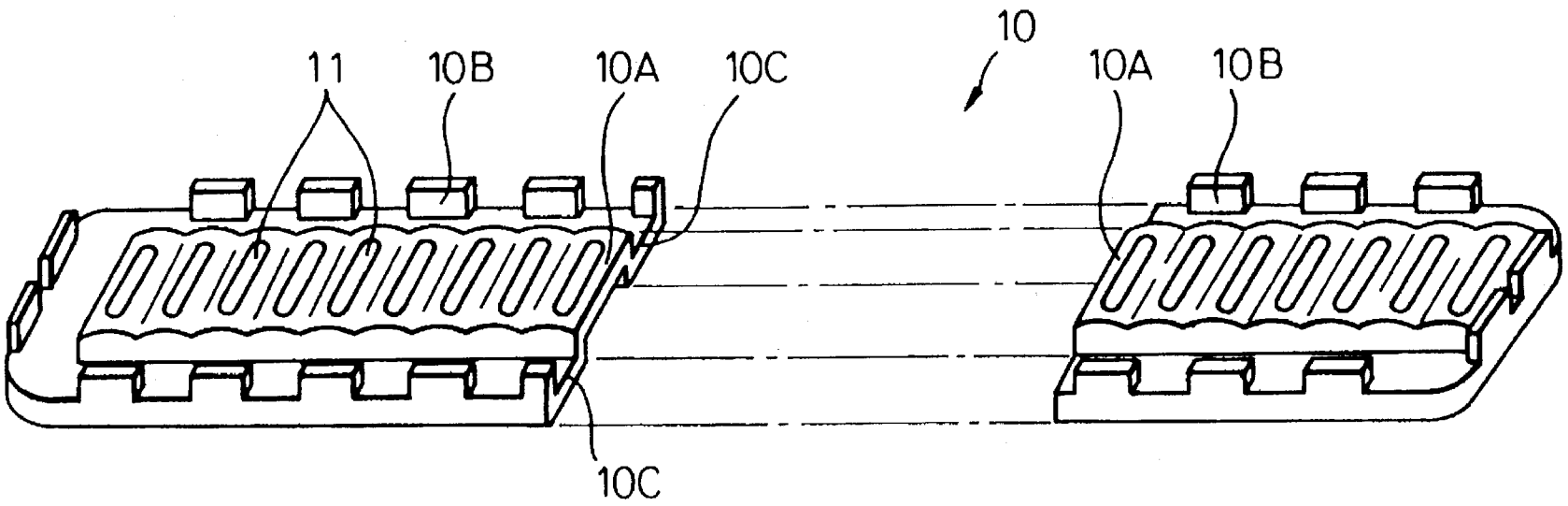
FIG. 1 is a perspective view illustrating an automotive radiator core plate as an example of pressed product according to the present invention.

To manufacture a core plate illustrated in FIG. 1, an inside protuberance 10A is formed by drawing in the primary forming process (A), and then an outer circumferential edge portion 10B bent upwardly are formed by drawing in the secondary forming process (B). According to this embodiment, dual drawing are not performed in single process using the same die like the conventional sequential pressing method but in two separate processes. In this way, damages which may be caused by the conventional sequential pressing to a seal surface 10C can be prevented.

Figure 2:
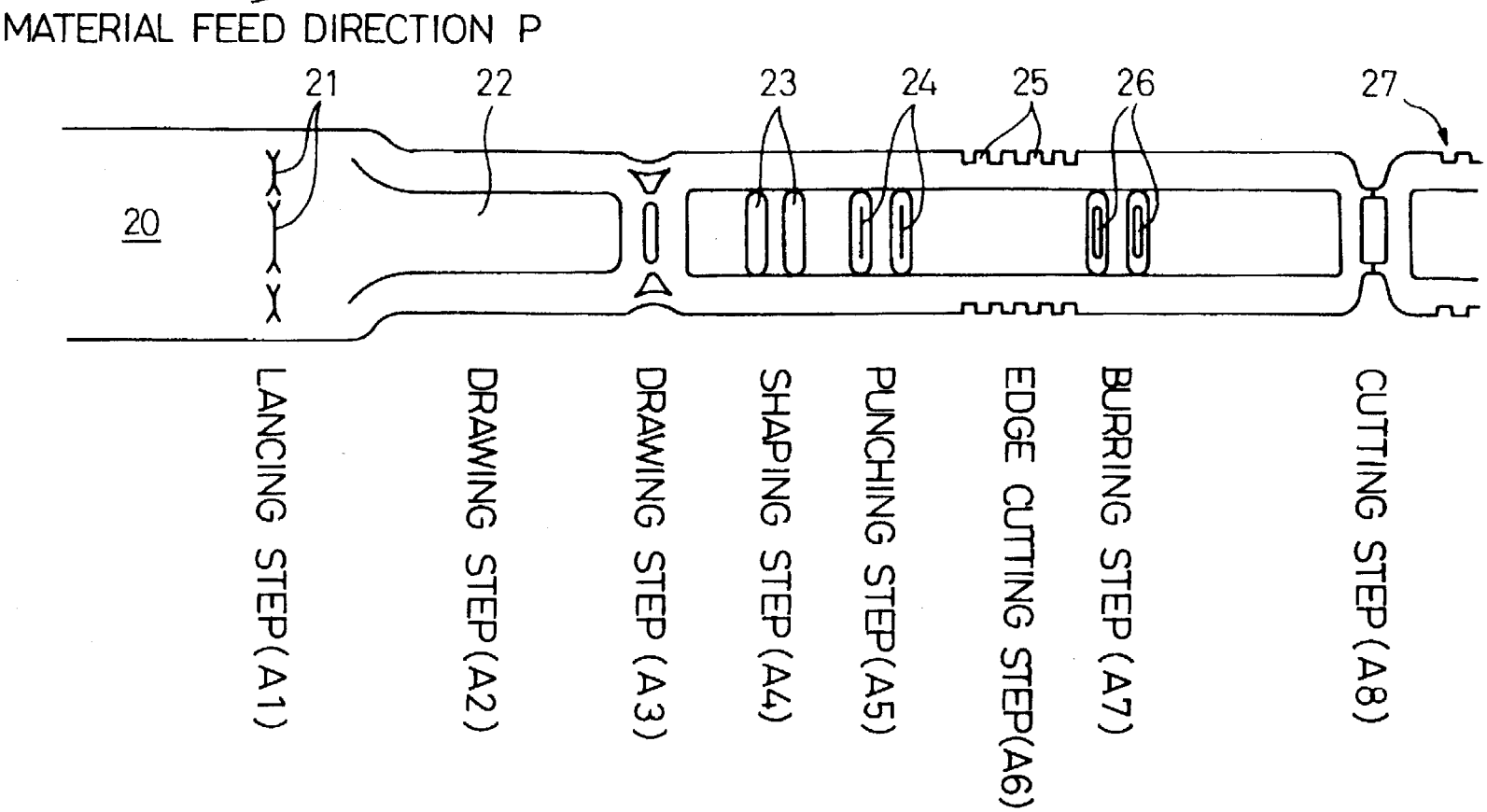
FIG. 2 is a plan view illustrating the progress in the shape of the band-like plate material in consecutive forming steps in the primary forming process (A), when the material is fed from left to right viewed in this figure at a specified pitch consecutively.

FIG. 2 is a plan view illustrating the progress in the shape of a band-like plate material in the primary forming process (A) according to the sequential forming processes of this embodiment. The material is fed at a specified speed from left to right in FIG. 2, while the forming process are performed sequentially.

In the primary forming process (A) illustrated in FIG. 2, a band-like plate material 20 fed from left to right in this figure is sequentially pressed. Such pressing process includes a lancing step (A1) for making cuts 21 to form a boundary between adjoining products, a drawing step (A2) for forming an inside protuberance 22, a drawing step (A3) for forming the cut portion, a shaping step (A4) for forming small protruded portions 23 to secure strength at the summit portion of the inside protuberance 22, a punching step (A5) for forming burring holes 24 in the protruded portions 23, an edge cutting step (A6) for forming claws 25 to be bent by crimping in the circumferential portion, a burring (A7) for making holes 26 by expanding the holes 24, and cutting step (A8) for separating the adjoining first pressed products 27 corresponding to the respective products. In these respective pressing steps, by intermittently forwarding and retracting punches for respective forming processes according to a specified product length with an air cylinder and a cam mechanism which will be described later, the primary pressed product according to the specified product length can be obtained.

Figure 3A:
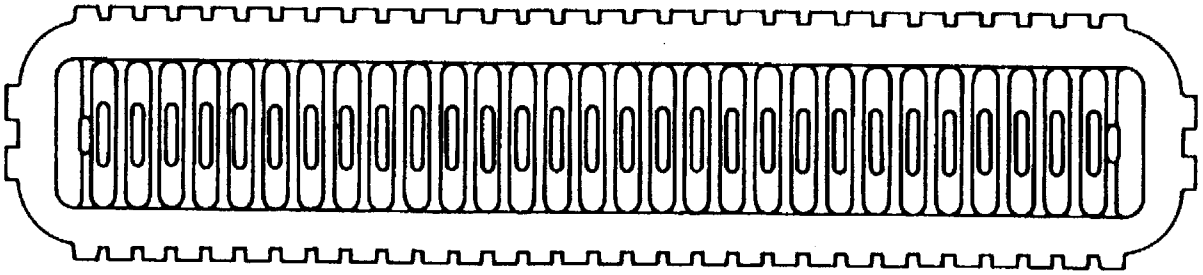
FIG. 3A is a plan view illustrating the primary pressed product obtained in the primary forming process (A) in FIG. 2.

FIG. 3A is a plan view of the primary pressed product obtained in the above primary forming process (A).

Out of all the above pressing stages (A1) through (A8), the following dies are used in the drawing step (A2) for forming the inside protuberance 22.

Figures 4A, 4B, 4C, 4D, 4E:
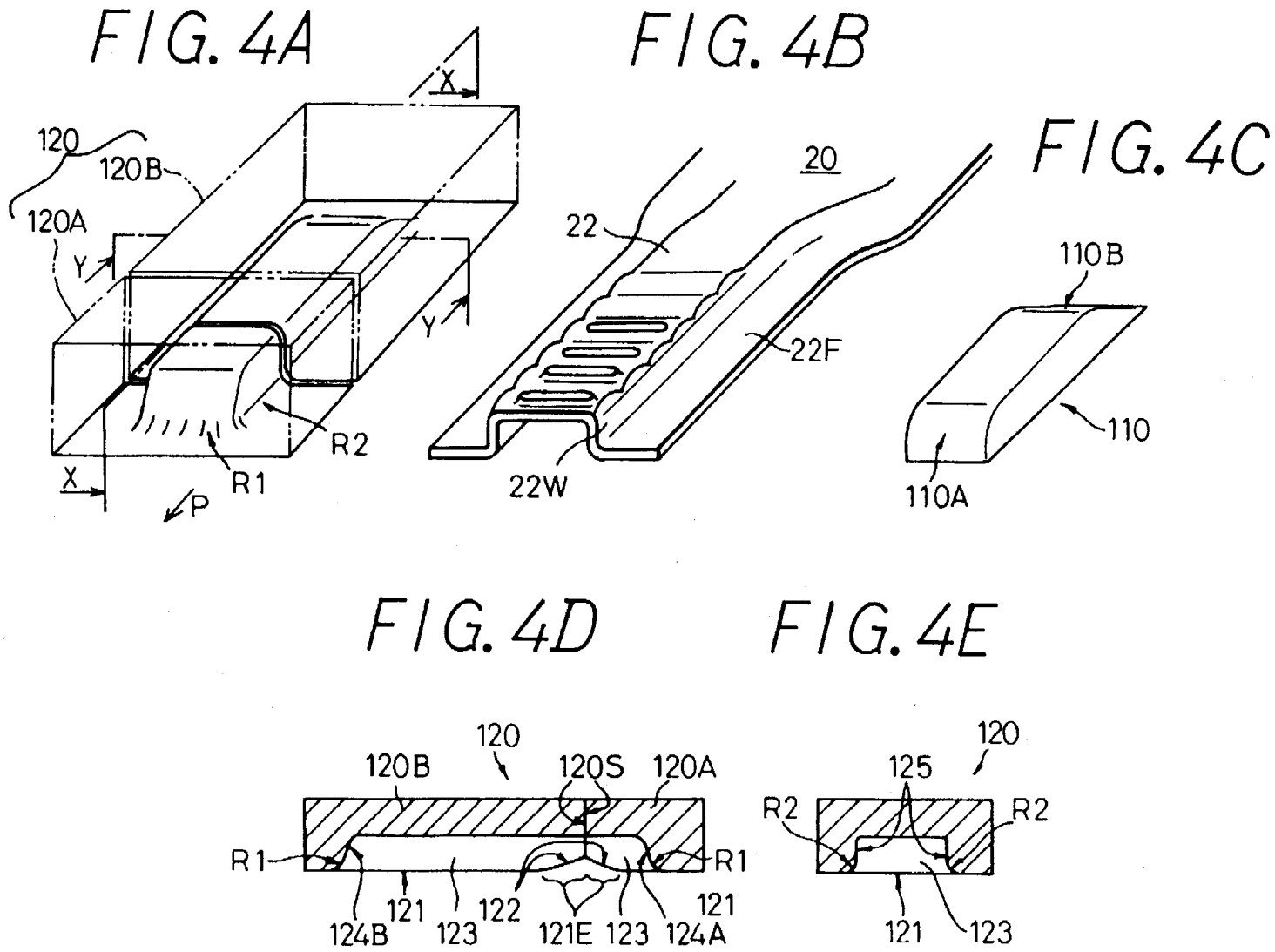
FIGS. 4A–4E are views for forming the inside protuberance by drawing the material in the primary forming process (A) according to an embodiment of the present invention.

FIG. 4 illustrates a punch 110 and a die 120 which are used for drawing for the inside protuberance 22, and the band-like material 20 in the inside protuberance forming process. In FIG. 4, which is a perspective view illustrating the die 120, a die cavity and a flange holding surface, which are directly related to the improvements according to the present invention, are shown by solid lines, and the other parts are shown by broken lines.

Figure 7:
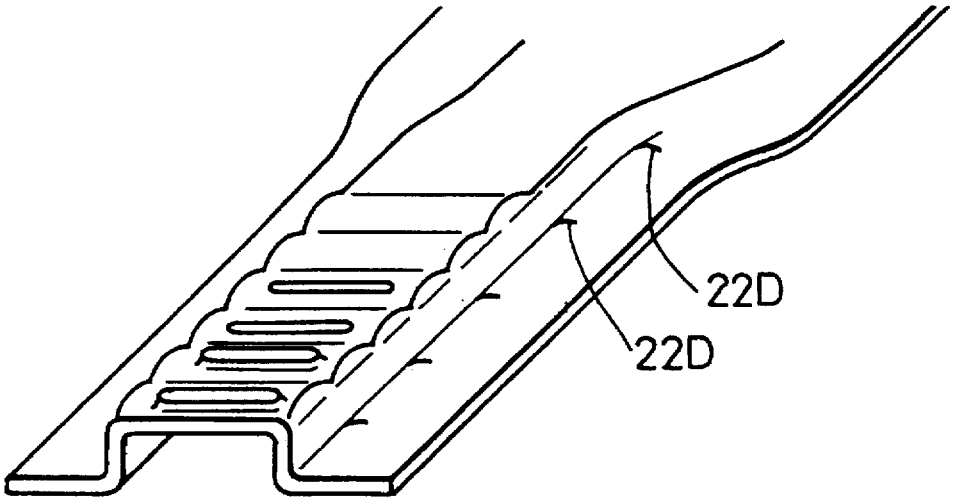
FIG. 7 PRIOR ART
FIG. 7 is a perspective view of damages (shock marks) caused by the improper roundness of both end corner portions of a die for use in the primary forming process (A) of the present invention.

The punch 110 can draw both ends 110A and 110B with respect to a material feed direction P. The die 120 corresponding to the punch 110 is divided into a first half die part 120A and a second half die part 120B with respect to the material feed direction P. A separate end portion 121E of a flange holding surface 121 of the first half die part 120A and second half die part 120B is provided with taper portions 122 toward separate surfaces 120S. In cavity 123 of the die 120, both on a front end surface 124A of the first half die part 120A and a rear end surface 124B of the second half die part 120B, the roundness of a corner part R1 with the flange holding surface 121 is more gentle than the roundness of a corner part R2 with both side surfaces 125 and flange holding surface 121 to prevent damages (shock marks) 22D as illustrated in FIG. 7, which may be caused to corner portions with protuberance part side surfaces 22W and flange surfaces 22F. For example, if the roundness of both side surface corner portions R2 is approximately 1 to 2 mm, the roundness of both end surface corner portions R1 is set to approximately 3 to 4 mm.

Figure 8A:
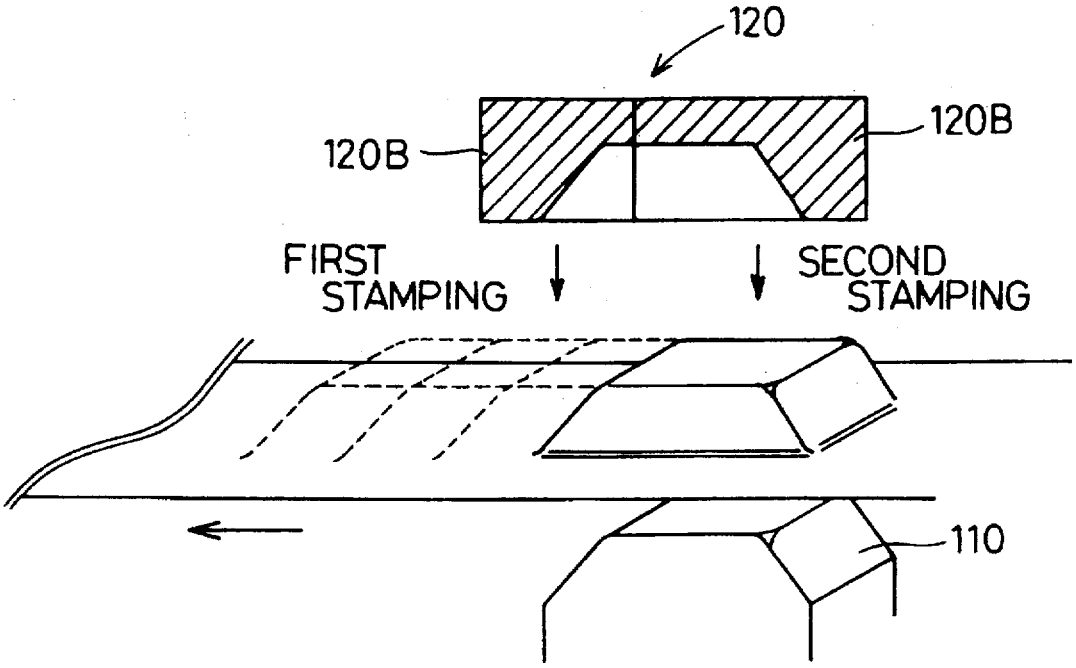
FIG. 8A is a perspective view illustrating a completed protuberance formed by drawing with a die unit including a punch and a die including a first half part die and a second half part die.
Figure 8B:
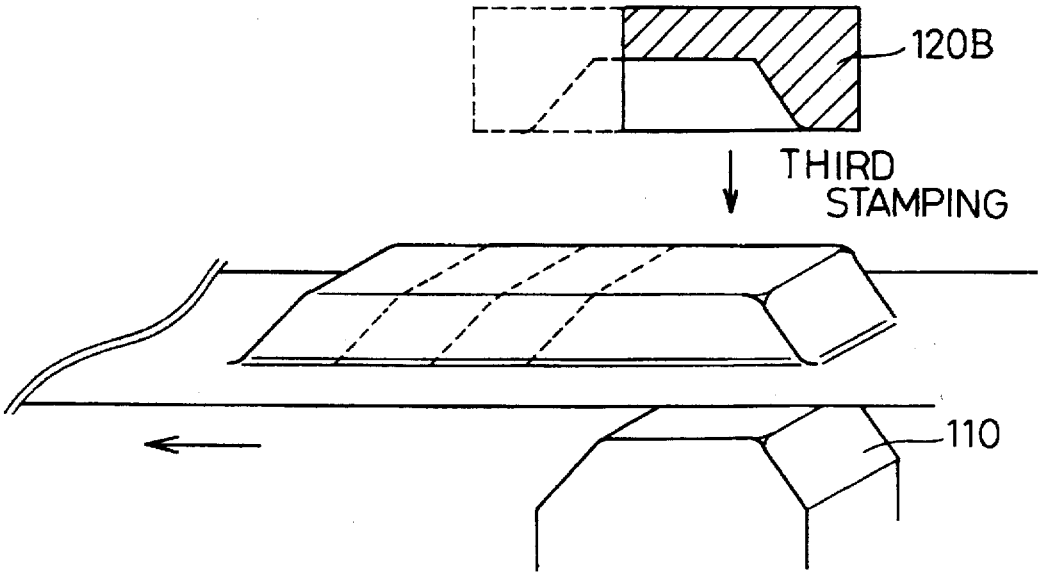
FIG. 8B is a perspective view illustrating an extended protuberance by drawing with the punch and the second half part die.

By using the above die, the inside protuberance 22 is consecutively formed as follow. In the first stamping step, by using both halves of the separate die parts 120A and 120B, a protuberance is formed in correspondence with the die cavity 123. In the second stamping step, the band plank material 20 is fed by a specified pitch, and then, pressing is performed by using the second half die part 120B only without using the first half die part 120A (staying in the lifted position). In this way, the front end portion of the protuberance formed in the first stamping step can be maintained in the formed shape as it is without being pressed by the first half die part 120A. On the other hand, the rear end portion of the protuberance formed in the first stamping step is subjected to the subsequent pressing. As a result, the rear end portion of the initial protuberance is protruded up to the summit portion of the protuberance, and new rear end portion of the protuberance is formed. FIG. 8A illustrates the completed protuberance in the second stamping step. Accordingly, the protuberance formed in the first stamping step is extended as long as the feed pitch in the second stamping step. Furthermore, in the third and subsequent stamping steps, the length of the protuberance can consecutively be extended every pitch, as shown in FIG. 8B. The advance and retract of the punch 110 is controlled by means of an air cylinder, a cam mechanism, or the like such that when the number of pitches reaches up to a set number which enables a specified length of the protuberance to be achieved, the punch 110 stays in the retracted position during this pressing operation to stop forming the protuberance. The advance and retract of the punch 110 is also controlled such that when the next product protuberance corresponding part is fed to the position of this die, the punch stays in the advanced position to form the protuberance.

Next, a mechanism for operating the punch 110 and the die 120 is described.

Figure 9A:
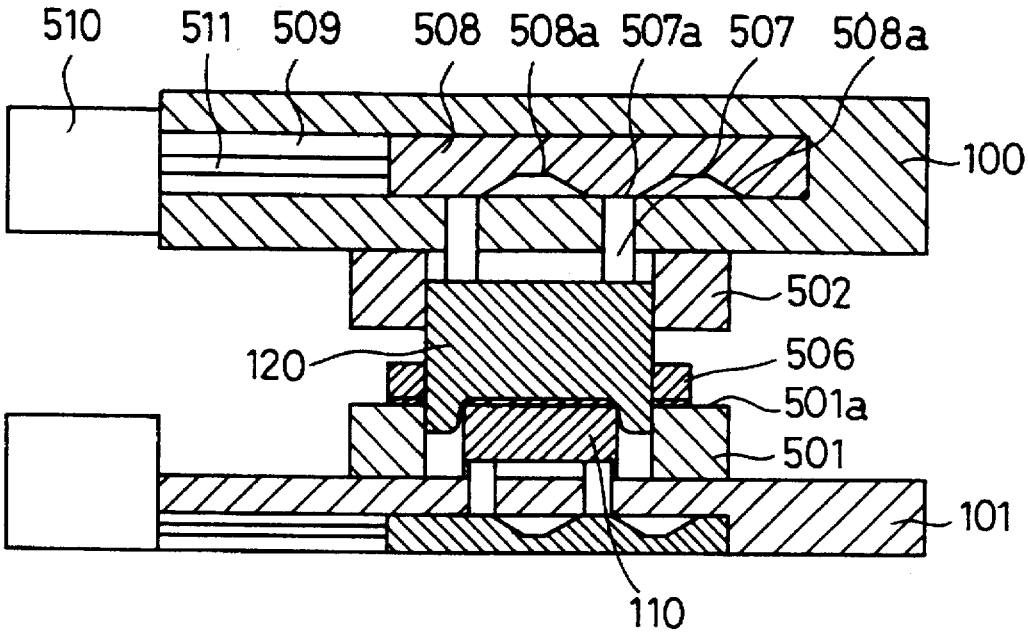
FIG. 9A is a view illustrating the state in which a upper die is lowered when the drawing process is performed.
Figure 9B:
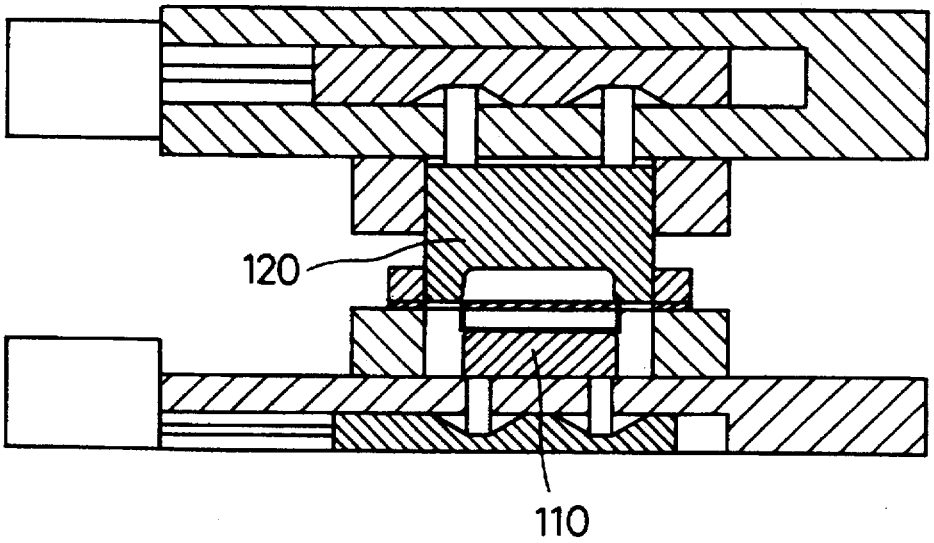
FIG. 9B is a view illustrating the state in which the upper die is lowered when the drawing process is not performed.

FIG. 9A is a view illustrating the state in which an upper die is lowered when the drawing process is performed, and FIG. 9B is a view illustrating the state in which the upper die is lowered when the drawing process is not performed.

As illustrated in FIGS. 9A and 9B, a sliding hole 509 is provided within the upper die 100 for each die 120 at a right angle to the moving direction of the die 120, and a cam rod 508 is slidably disposed within the sliding hole 509. The cam rod 508 is provided with a driving means 510, such as air cylinder, to move and drive the cam rod 508. The cam rod 508 is fixed to the tip end portion of a driving shaft 511, and is driven so as to slide within the sliding hole 509 by the driving force of the air cylinder 510. Rods 507 extend from the top surface of the die 120, and the top end portions of the rods 507*a* are in contact with the cam rod 508. Each rod 507 is provided with a mechanism (not illustrated) for constantly urging the rod 507 upwardly energizing mechanism by means of elastic force, such as spring force, like a mechanism for urging the burring punch 401 upwardly in the burring step. The cam rod 508 is provided with a recessed trapezoidal cam surface 508*a* at two locations. A lower die 101 is provided with a punch base 501, and the punch base 501 is provided with a punch 110 to be vertically advanced and retracted in the position corresponding to each die 120. A mechanism for advancing and retracting the punch 110 is the same as that for advancing and retracting the die 120, and operates so as to advance and retract only as much as the height of the drawing at both end portions of the material. Above the punch base 501, a material holding plate 506 is provided on the die base 502 through an elastic material (not illustrated), such as spring, which holds the material by capturing the same with a top surface 501*a* of the punch base 501 when the upper die 100 is lowered.

When the upper die 100 is lowered by a well-known driving means, the material holding plate 506 presses the material and then holds the material with the top surface 501*a* of the punch base 501. When the material is further lowered, as the material holding plate 506 is disposed on the die base 502 through an elastic member, such as spring, the upper die 100 is further lowered while the elastic member is compressed. Then, both end portions of the material are drawn by the die 120. When the upper die 100 has been positioned to the specified lower end position and all the forming steps have been completed, the upper die 100 is lifted again to the upper end position.

Figure 3B:
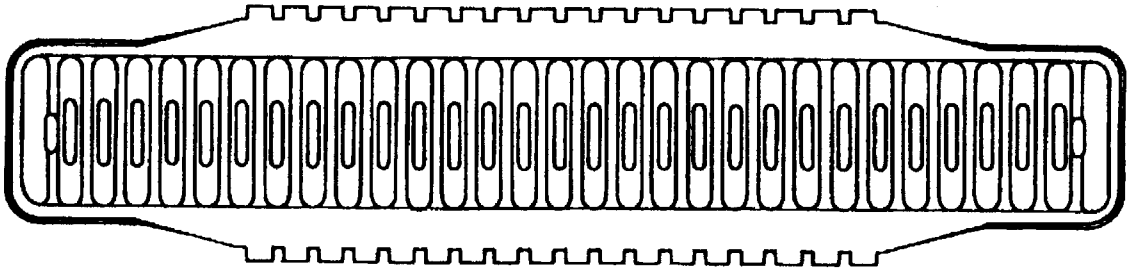
FIG. 3B is a plan view illustrating the outer circumferential edge bent upwardly at both end portions of the above primary pressed product formed by drawing in the primary step in the secondary forming process (B)
Figure 3C:
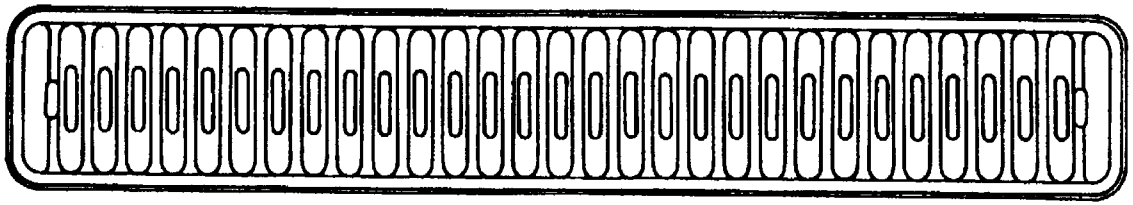
FIG. 3C is a plan view illustrating the outer circumferential edge bent upwardly at the central portion formed by drawing in the second step in the secondary forming process (B) after the edge has been bent upwardly at both end portions.

The primary pressed product obtained through the above sequential forming steps (A1–A8) is transferred to the secondary forming process (B) which consists of two steps. FIG. 3B is a plan view illustrating the primary pressed product with the outer circumferential edges, which have been bent upwardly by deep-drawing, of both end portions to form an inner groove therearound in the first step. On the other hand, FIG. 3C is a plan view illustrating the primary pressed product with the outer circumferential edges, which are bent upwardly by deep-drawing, of the central portions to form an inner groove therearound after the outer circumferential edges of both end portions have been bent upwardly.

Figure 5:
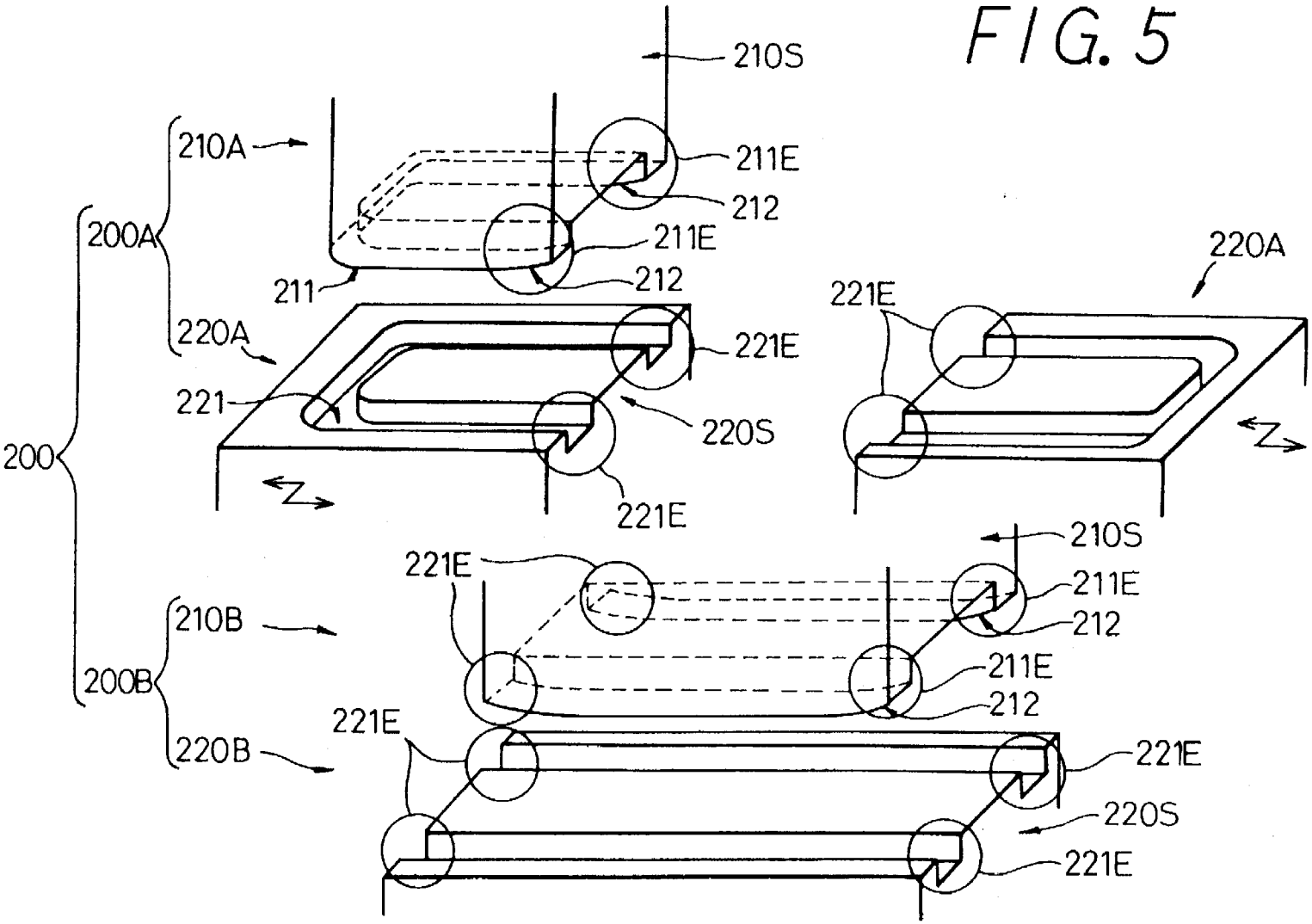
FIG. 5 is a perspective view illustrating a die unit divided into a punch and a die for both end portions and a punch and a die for the central portion.
Figure 6:
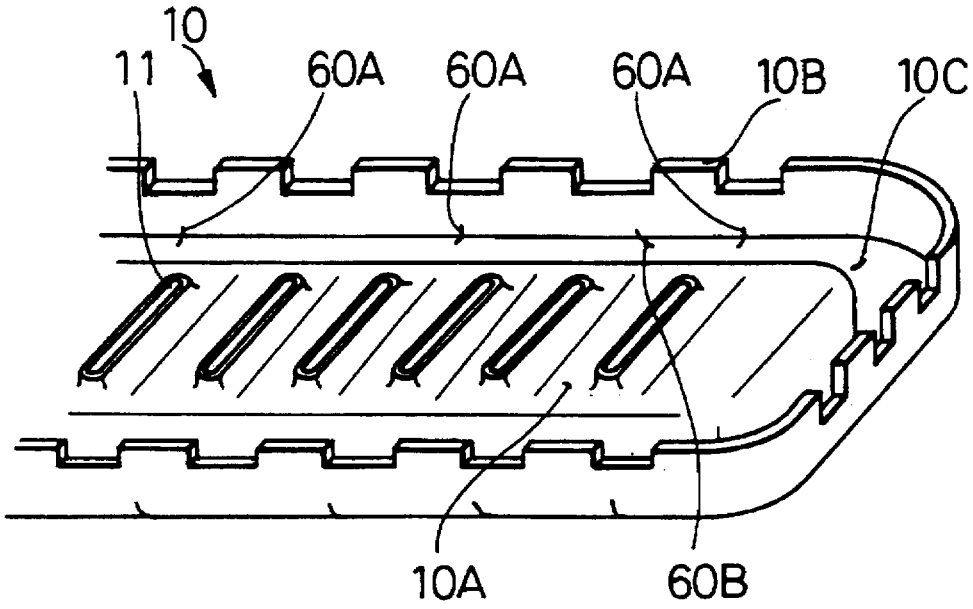
FIG. 6 PRIOR ART
FIG. 6 is a perspective view illustrating damages (shock marks) on the packing seal surface caused in the forming of the radiator core plate of FIG. 1 by the conventional sequential forming method.

In performing the secondary forming process (B) according to this embodiment, as illustrated in FIG. 5, both end portions and the central portion of the outer circumference are drawn so that the edges are bent upwardly in separate steps by using separate die units, one die unit for both end portions, which includes a punch 210A and a die 220A, and another die unit for the central portion, which includes a punch 210B and a die 220B to complete the inner groove by the circumference edge portion. This technique of respective forming step for both end portions and for central part of outer circumference by using separate two die units is the same as one disclosed in the Japanese Unexamined Patent Publication No. 6-79360, in which the space between the die units for both end parts 200A can be varied according to the product length.

According to the this embodiment, however, at least either a front end punch surface 211 or a bottom die surface 221 (only the front end punch surface 211 in FIG. 5 is provided with taper parts 212 on separate end parts 211E toward a separate surface 210S (220S). By this arrangement, as described for the separate die 120 in the primary forming process (A), damages which may be caused to the separate surfaces 210S and 220S (particularly to a packing seal surface 10C in FIG. 1) due to the inflow of the material to be drawn can be prevented.

The length in the effective pressing region is set both to the die 200A for both end portions and the die 200B for the central portion in such a manner that pressing can be performed by the flat portion without the taper portions 212 and the total of both pressing length excluding the taper portions 212 can certainly be longer than the specified product length.

Actually, in the vicinity of the separate surface of the die, a portion of the material is certainly double pressed by the non-taper portion (flat portion) of the die 200B for the central portion in the two-steps forming.

In short, by setting the length of the die 200B for the central portion to be long enough not to deform both end portions formed in the first step, it is possible to form a wide range of product lengths.

As described above, the outer circumferential edge portions can be formed to be bent upwardly without using pitch feeding. Therefore, the outer circumferential edge portions is formed by the secondary forming process (B) including two-steps method for forming a variable length product rather than the primary forming process (A). It is advantageous for downsizing the dies and a pressing apparatus for the primary forming process to separate the primary forming process and the secondary forming process according to the present invention.

In the above embodiment, the most preferable method using the improved dies for both the primary forming process (A) and the secondary forming process (B) has been described. It should be noted, however, that the tolerance of the damages on the seal surface (the surface 10C in FIG. 1) is so severe that the embodiment is based on the assumption that the tolerance is not more than 10 to 20 μm, for example.

If the tolerance of damages on the seal surface is not so severe, it is possible to apply the improved die as described above to either the primary molding process (A) or the secondary molding process (B).

As described above, according to the present invention, a pressing method for forming dual drawn products, such as radiator core plates, having various product lengths with one type of die, and for preventing significant damages, which may be caused to the packing seal surface, as well as a pressing apparatus for implementing such pressing method can be provided.

The present invention having been described should not be limited to the disclosed embodiments, but it may be modified in many other ways without departing from the scope and the spirit of the invention. Such changes and modifications are to be understood as being included with the scope of the present invention as defined by the appended claims.

What is claimed is:

1. A method for pressing a material fed in a material feed direction to manufacture a product with a die unit including a punch and a die corresponding to said punch, said product having a first end portion and a second end portion with respect to the material feed direction, said die being divided into a first half die part and a second half part with respect to said material feed direction; said pressing method comprising steps of:

a first drawing step for drawing said material in said material feed direction with said punch and said first die part of said die to form said first end portion of said product; and a second drawing step for drawing said material in said material feed direction with said punch and said second die part of said die to form said second end portion of said product, wherein in each of said drawing steps, a length of material drawn is variable.

2. A pressing method according to claim 1, wherein said second drawing step includes a plurality of steps for repeatedly drawing said second end portion of said product with said punch and said second die part of said die to extend the length of said product.

3. A method for pressing a belt-like material fed in a material feed direction to manufacture a dual-drawn and long product having a protruded inside formed by drawing and outer circumference edge portions, bent upwardly by drawing, of both end portions and a central portion with respect to said material feed direction to form an inner groove therearound, said method comprising:

a primary forming process for deep-drawing said material in the material feed direction to form a first pressed product having said protruded inside with a die unit including a punch for drawing said both end portions and a die corresponding to said punch so as to form a die cavity therewith, said die being divided into a first half die part and a second half part with respect to said material feed direction and having a flange holding surface to form said inner groove, wherein a length of material drawn may be made variable.

4. A method for pressing a belt-like material fed in a predetermined direction to manufacture a dual-drawn and long product having a protruded inside formed by drawing and outer circumference edge portions, bent upwardly by drawing, of both end portions and a central portion with respect to said material feed direction to form an inner groove therearound, said pressing method comprising:

a primary forming process for deep-drawing said material to form a first pressed product having said protruded inside with a die unit including a punch for drawing said both end portions and a die corresponding to said punch so as to form a die cavity therewith, said die being divided into a first half die part and a second half part with respect to said material feed direction and having a flange holding surface to form said inner groove, wherein said separate end portions of said first die part and said second die part is formed in a taper shape, said die for forming said die cavity includes a front corner portion between a front end surface of said first die part and said flange holding surface, a rear corner portion between a rear end surface of said second die part and said flange holding surface and side corner portions between each side surface and said flange holding surface, and roundness of both said front corner portion and said rear corner portion being more gentle than that of said corner portions.

5. A method for pressing a belt-like material fed in a predetermined direction to manufacture a dual-drawn and long product having a protruded inside formed by drawing and outer circumference edge portions, bent upwardly by drawing, of both end portions and a central portion with respect to said material feed direction to form an inner groove therearound, said pressing method comprising:

a primary forming process for deep-drawing said material to form a first pressed product having said protruded inside with a die unit including a punch for drawing said both end portions and a die corresponding to said punch so as to form a die cavity therewith, said die being divided into a first half die part and a second half part with respect to said material feed direction and having a flange holding surface to form said inner groove, further comprising:

a secondary forming process sequentially including a step for deep-drawing said primary pressed product to form said outer circumference edge portion of said both end portions and a step for deeply drawing said first pressed product to form said outer circumference edge portion of said central portion with a die unit divided into separate die units for said both end portions and said central portion, respectively.

6. A pressing method according to claim 5, wherein at least one of separate end portions of said separate die units is formed in a taper shape.

7. A pressing method according to claim 3, said first half die part is intermittently controlled.

8. A pressing apparatus for a dual-drawn and long product having a protruded inside formed by drawing and outer circumference edge portions, bent upwardly by drawing, of both end portions and a central portion with respect to a material feed direction to form an inner groove therearound, said pressing apparatus comprising:

(A) a first forming unit for deep-drawing said protruded inside, said first forming unit including:

(a-1) a punch for drawing said both end portions;

(a-2) a die corresponding to said punch so as to form a die cavity therewith, said die being divided into a first half die part and a second half part with respect to said material feed direction and having a flange holding surface to form said inner groove; and (a-3) means for selectively intermitting each operation of said first die part and said second die part, and (B) a second forming unit for deep-drawing said outer circumference edge portions, said second forming unit including:

(b-1) a die unit divided into two separate die units, one for said outer circumference edge portion of said both end portions, another for said outer circumference edge portion of said central portion, and (b-2) means for selectively intermitting each operation of said separate die units.

9. A pressing apparatus according to claim 8, wherein said separate end portions of said first die part and said second die part are formed in a taper shape, said die for forming said die cavity includes a front corner portion between a front end surface of said first die part and said flange holding surface, a rear corner portion between a rear end surface of said second die part and said flange holding surface and side corner portions between each side surface and said flange holding surface, and roundness of both said front corner portion and said rear corner portion are more gentle than that of said side corner portions.

* * * * *